United States Patent [19]

Hanson

[11] 4,038,764

[45] Aug. 2, 1977

[54] SHEARING EXCAVATOR

[76] Inventor: Raymond A. Hanson, P.O. Box 7400, Spokane, Wash. 99207

[21] Appl. No.: 678,691

[22] Filed: Apr. 20, 1976

[51] Int. Cl.[2] ..... E02F 5/00

[52] U.S. Cl. ..... 37/110; 37/108 R; 37/115; 198/520; 299/34

[58] Field of Search ..... 37/110, 115, 190, 108 R, 37/108 A; 299/32, 34; 198/520, 517, 510, 519

[56] References Cited

U.S. PATENT DOCUMENTS

| | | | |
|---|---|---|---|
| 11,382 | 7/1854 | Lyon | 37/110 |
| 1,818,457 | 8/1931 | Briggs et al. | 37/115 X |
| 1,912,583 | 6/1933 | Kugler | 37/110 |
| 2,394,458 | 2/1946 | Lull | 37/DIG. 3 |
| 2,689,717 | 9/1954 | Bainbridge | 299/34 |
| 3,306,476 | 2/1967 | McMillan | 37/190 X |
| 3,310,893 | 3/1967 | Perry et al. | 37/192 R |
| 3,530,599 | 9/1970 | Holland | 37/110 |
| 3,922,802 | 12/1975 | James | 37/DIG. 16 |

FOREIGN PATENT DOCUMENTS

| | | | |
|---|---|---|---|
| 606,525 | 8/1948 | United Kingdom | 299/34 |
| 708,336 | 5/1954 | United Kingdom | 299/34 |

*Primary Examiner*—Clifford D. Crowder
*Attorney, Agent, or Firm*—Wells, St. John & Roberts

[57] ABSTRACT

A shearing excavator including a unique blade assembly for removing earth in successive layers from a substantially upright face. The successive earth layers are removed by pulling a blade assembly along the full length of the face. The blade assembly is connected to a longitudinal framework that provides support for an earth receiving and transporting conveyor. This conveyor receives material deflected from the blade assembly and directs it to a discharge end adjacent one end of the excavator framework. A lateral conveyor receives the discharged material and moves it to a remote location for further processing. The blade assembly includes an upright first blade with a substantially upright cutting edge. The bottom end of the upright cutting edge is located at a point above the lower edge of the face, leaving a portion thereof to be removed by a second blade. The second blade is horizontally inclined and includes a substantially horizontal forward cutting edge that is located rearward of the first upright cutting edge (with respect to a forward direction travel of the blade assembly). The second blade is inclined upwardly from its cutting edge which is located at the loweredge of the face. The second blade cuts through the earth along the face that remains below the bottom edge of the upright blade.

5 Claims, 5 Drawing Figures

SHEARING EXCAVATOR

BACKGROUND OF THE INVENTION

The present invention relates to earth removing equipment and more particularly to such equipment utilized for excavating material along a "face" or upright planar earth surface of an area to be excavated.

It has long been desirable to provide earth excavating equipment that will effectively remove ore deposits or other earthen material from an upright face. It is also desirable to obtain some form of apparatus that will remove material in successive layers from a face while simultaneously moving the separated material to a remote location.

U.S. Pat. No. 2,689,717, granted to F. Bainbridge, on Sept. 21, 1954, discloses a plow-mining method and apparatus. In this particular apparatus, a double-edged cutting blade is utilized to remove material from a vertical face while traveling backwardly or forwardly along a framework aligned parallel to the face. Opposite ends of the framework are movably mounted to tracks that enable incremental movement of the apparatus towards the face after each successive cut. The cutting edge of the blade assembly extends from the top to the bottom edge of the face. It includes a vibrating assembly that is operatively connected to the forward cutting edges of the blades to facilitate a smooth passage of the blades through the earth engaged therewith. The blades are moved by cables that are attached to the blade carrying carriage.

U.S. Pat. No. 3,245,722, to F. H. Creules, et al., issued Apr. 12, 1966, discloses a mining face conveyor in which a double-edged cutting blade assembly is moved along the length of a face in order to remove successive layers of materials from the face and deposit such material unto a conveyor that is oriented parallel to the face. The cutting assembly is specifically designed so a leading cutting edge will dig into the face while the following or rearward cutting edge is held clear of the face. When the blade assembly is moved in the opposite direction, the assembly is pivoted so the other assemblies engage the face and above mentioned assembly is pivoted clear of the face. Cutting edges of the blade assembly produce a face that is relatively upright by nature, but has an upper portion that is indented further than a lower face portion. The cutting operation is performed by two separate blade portions. A forward blade portion removes the bottom part of the layer while rearward blade portion removes the indented upper part of the face. U.S. Pat. No. 2,539,962 to J. B. Mavor, issued Jan. 30, 1951, discloses a mining machine that includes a blade assembly in which the shearing components are longitudinally movable relative to each other. In operation, on of the components advances longitudinally while the other is held stationary. Once the one element if fully extended, it is held stationary while the remaining element is advanced to overtake the first element. Thus, an "inch-worm" effect is produced by the alternately movable slicing components.

U.S. Pat. No. 3,530,599 granted to F. H. Holland, on Sept. 29, 1970, discloses an elevating belt loader and excavation apparatus. This assembly also makes use of shearing blades to cut successive layers from an upright face. Two distinct blades are utilized to cut a step-shaped formation as the blade assembly moves longitudinally along the face. An upright blade makes a vertical cut line along the face while, at the same time, a horizontal blade makes a horizontal cut that is outboard in relation to the vertical cut. The material from both blades is directed onto a lateral conveyor to be moved from the area of the face laterally outward to a discharge end and into a receiving truck or other means of transportation.

Another excavating device is shown by M. E. Lasher in U.S. Pat. No. 150,767, patented May 12, 1874. This device, instead of using two separate slicing elements, uses a plow share and mold board. This unit is utilized by the device to shear off successive layers of material and direct it onto a lateral conveyor.

A horizontal blade in an excavation device is described in U.S. Pat. No. 11,382, granted to J. Lyon and issued July 25, 1854. This device uses a substantially horizontal blade that is inclined upward in a rearward direction to a lateral discharge conveyor. As the device is pulled in a forward direction a horizontal blade engages the earth and liftsa layer thereof upwardly along the inclined plane and finally onto the lateral discharge conveyor.

U.S. Pat. No. 2,386,187 to R. Q. Armington et al issued Oct. 9, 1945, also discloses a scoop-type excavator that is somewhat similar to the Lyon device only having a discharge conveyor that forms an acute angle at the forward direction of travel rather than a perpendicular angle as disclosed by Lyons.

Other scooping and associated conveying apparatus are disclosed in U.S. Pat. Nos. 3,245,159; 3,885,332; 3,778,912; 3,470,634; and 839,516.

Nearly all the above cited and disclosed patents operate on the principle of the ordinary plow share and mold board that is disclosed in U.S. Pat. No. 150,767, granted in 1874, wherein a basically wedge shaped ground breaking element is utilized. This element may be basically described in two components — one being a lower cutting element that protrudes forwardly and below an upward and rearward second element. The two elements are joined by a smooth curved surface designed to direct material (disengaged by the leading lower element) upwardly and to one side of the upward element. The difficulty here arises from the fact that the lower end must be pushed or pulled through the earth and therefore bear the burden of the entire depth of the cut; whereas, if the upper part preceded the lower part, the upper portions of the cut could be removed before the lower portion becomes engaged with the lower cutting edge. Therefore, less weight and drag would be sustained by the cutting elements when in operation as opposed to the older lower leading edge types.

SUMMARY OF THE INVENTION

A shearing excavator is described for stripping earth from a horizontal, elongated upright face that extends elevationally between longitudinal top face edge and a longitudinal bottom face edge. This is accomplished in successive layers along the length of the face. The excavator includes an elongated framework that extends along the full length of the face and is substantially parallel thereto. A carriage is movably mounted to the framework for movement thereon in a forward and backward direction. The carriage is mounted to the framework so it projects therefrom toward the face. A blade assembly is mounted to the carriage for movement therewith, and basically includes an upright first blade and an inclined second blade. The upright first blade includes an upright edge that leads from the top edge of the base to a bottom end at an elevation above the bottom face edge. The upright blade operates against the face while the carriage is moved in a forward direction. The inclined second blade includes a horizontal cutting edge that is located at the bottom face edge directly below and rearward of the scraper edge. It leads rearwardly from the horizontal edge to a rearward blade end that is located at an elevation above the bottom scraper end. Drive means is provided for moving the carriage and blade assembly along the face in the forward and rearward directions. Earth receiving and transporting means are also provided to receive earth as it is removed from the face by the blade assembly and for transporting the removed earth to a remote location.

It is a first object of the present invention to provide a shearing excavator wherein a two-element blade assembly includes a vertical cutting blade portion that is spaced ahead of (with respect to a forward direction of travel) a horizontal inclined rearward blade — in which the forward blade is utilized to remove an upper portion of a cut section while the lower rearward blade removes the remaining lower portion of the cut.

Another object is to provide such a shearing excavator that will provide a substantially continuous flow of material to a location remote from the operating site.

A further object is to provide such an excavation machine that requires considerably less power to operate than previous machines for performing essentially the same function.

A still further object is to provide such an excavator that is relatively simple in construction, easy to maintain, and easy to operate.

These and still further objects and advantages will become apparent upon reading the following detailed description which, taken with the accompanying drawings, discloses a preferred form of the present invention. It should be noted however, that various changes and modifications may be made therein without departing from the intended scope of the invention. It is therefore intended that only the claims, found at the end of this specification, are to be taken as definitions and restrictions upon the scope of my invention.

DETAILED DESCRIPTION OF A PREFERRED EMBODIMENT

Figures 1, 2, 3:
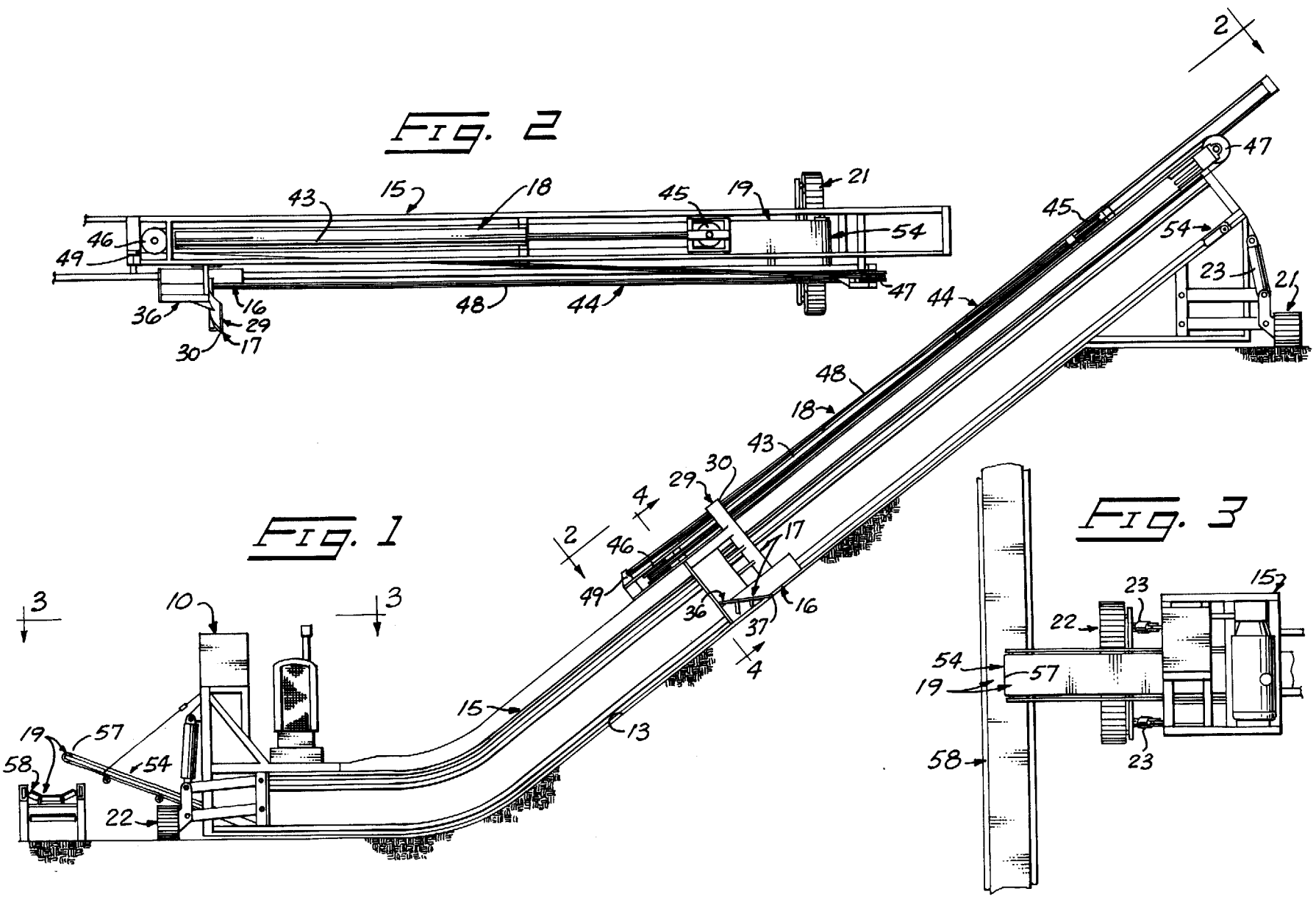
FIG. 1 is an elevational view of the present invention.
FIG. 2 is a fragmentary view as seen from lines 2—2 in FIG. 1.
FIG. 3 is a fragmentary plan view as seen from lines 3—3 in FIG. 1.
Figure 4:
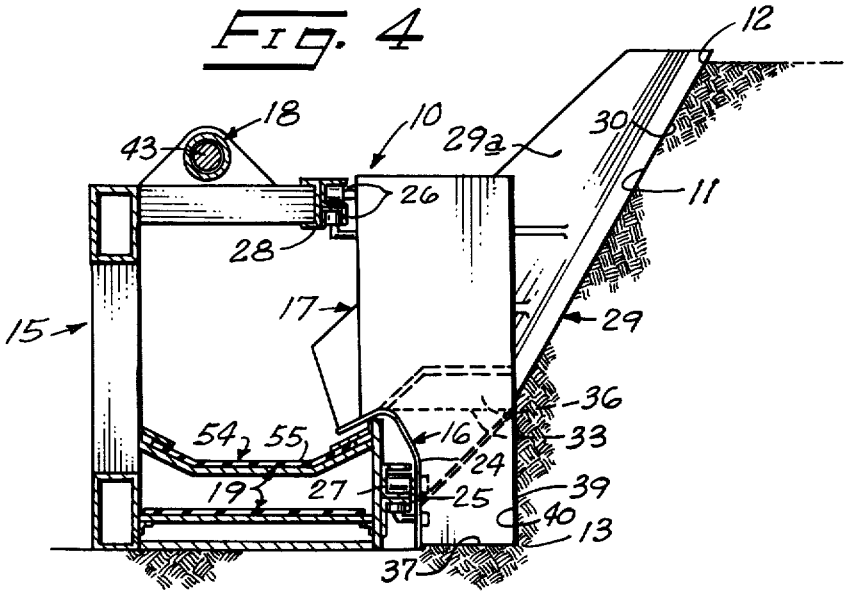
FIG. 4 is an enlarged sectional view taken substantially along line 4—4 in FIG. 1 only showing the relationship of elements therein to a "face"

A preferred form of the present excavator is illustrated in the accompanying drawings and generally designated therein by the reference character 10. It is intended that the excavator 10 be utilized against an elongated face 11 of earth and/or mineral deposits. As shown in FIG. 4, the face includes a longitudinal top edge 12 and a substantially parallel longitudinal bottom edge 13. The face is not shown in FIG. 1. However, the lower or bottom face edge 13 is shown as a line extending from the lower left hand corner to the upper right hand corner of the drawing sheet. It is not necessary that the face be angulated as shown in FIG. 1. However, it is desirable to operate the present device under such conditions in order that successive layers of material may be removed from the face 11 and be assisted by gravity to move toward the lower elevation.

The excavator 10 is basically comprised of an elongated framework 15 that extends substantially parallel to face 11 beyond opposite ends thereof. The framework 15 movably supports a carriage 16 adjacent face 11. The carriage mounts a blade assembly 17 that is utilized to scrape or cut against the face 11 to remove successive layers of earth or minerals therefrom. A drive means 18 is provided to move the carriage and blade assembly in a forward and backward direction along the framework 15 so while moving in the forward direction, the blade assembly will remove a layer from the face 11. The face material removed by the blade assembly 17 is directed to an earth receiving and transporting means 19. Means 19 is provided to receive the loosened material and move it to a remote location for further processing.

Framework 15 is best shown in FIGS. 1, 2 and 3. It includes a upper support track 21 and a lower track 22. Tracks 21 and 22 provide primary support for the entire length of framework 15 at opposite ends thereof. The tracks operate against the ground surface and are connected to framework 15 through parallelogram, hydraulic lifting assemblies 23. These assemblies 23 facilitate adjustment of the cutting depth for blade assembly 17 by raising or lowering the framework 15 relative to the ground surface. The tracks 21 and 22 also facilitate lateral movement of the complete excavator 10 so that it may move in increments toward the face 11 as progressive layers are removed therefrom.

The carriage 16 is shown in detail by FIG. 4. Carriage 16 includes a mounting plate and bracket assembly 24 that is movably mounted to framework 15 by a lower set of wheels 25 and an upper set 26. The wheels 25 and 26 are freely rotatably received within complementary tracks 27, 28 of the framework 15. No provision is made to drive the wheels. They are utilized only to guide the blade assembly in a forward and backward direction along the framework and to react against forces applied by the blade assembly 17 when in operation. The wheels are spaced both vertically and longitudinally on the bracket assembly 24 in order to stabilize the blade assembly against undesirable lateral movement and/or elevational movement while in operation.

Figure 5:
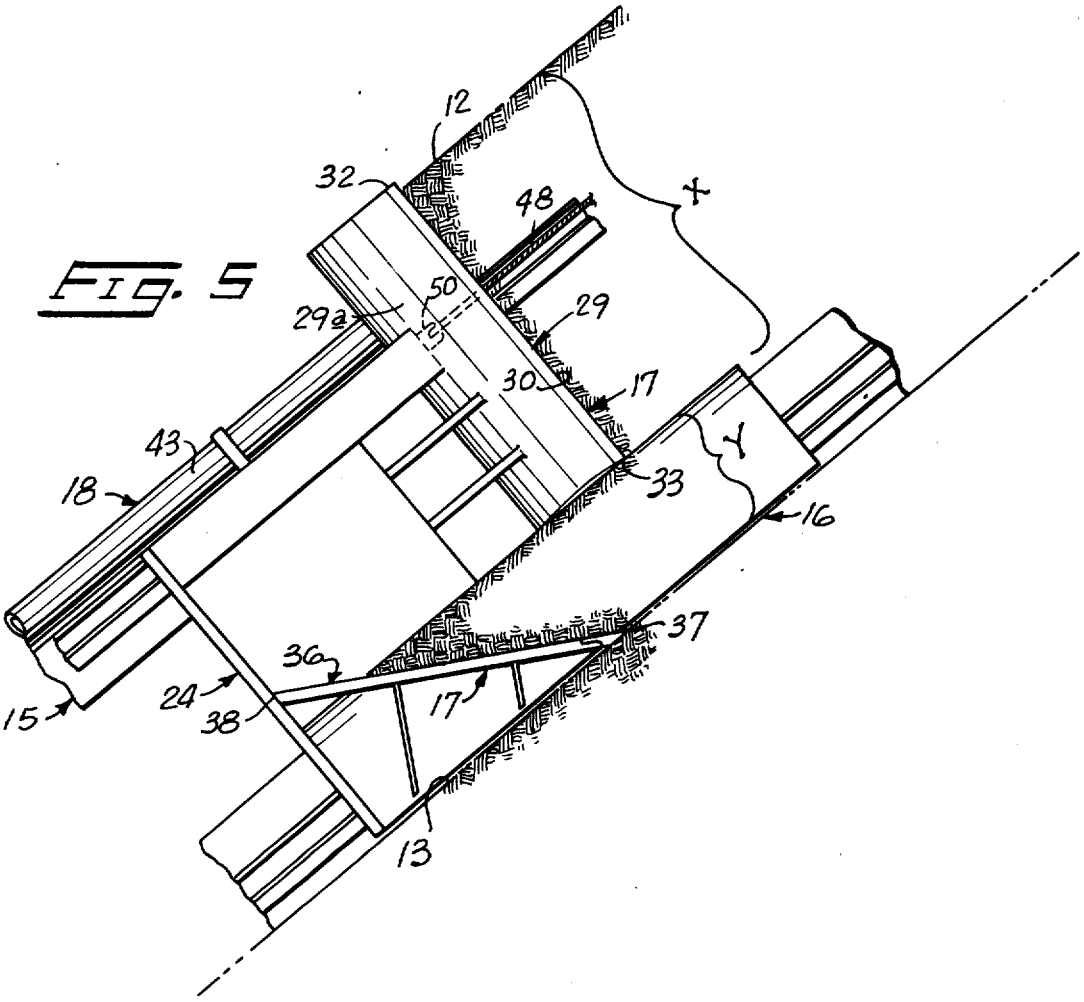
FIG. 5 is a side elevational view illustrating the cutting operation of the blade assembly for the present device.

Details of the blade assembly 17 may best be seen with reference to FIGS. 4 and 5. As briefly discussed above, the blade assembly 17 is connected directly to the carriage 16. It is rigidly mounted to the carrige for movement therewith. However, it is conceivable that provisions may be made to facilitate adjustment of the blades in order to change their relative stationary positions. This would be done according to differing exterior factors such as the type of material being excavated.

Assembly 17 basically includes an upright first blade 29 and a horizontally inclined second blade 36. The upright first blade 29 includes an upright edge 30 that extends elevationally from the face top edge 12 at a top blade end 32 downwardly to a position above the face bottom edge 13 to a bottom blade end 33. It is important to note that the bottom blade end 33 is located a fixed distance above the bottom face edge 13. It is also important to note the longitudinal relationship of the first blade 29 to the second blade 36.

Second blade 36 includes a horizontal cutting edge 37 that is located at the bottom base edge 13. The blade extends in an inclined manner, rearwardly from the edge 37 to a rearward blade end 38. Blade 36 includes a longitudinal blade edge 39 that is utilized to form an upright portion 40 of the face 13. The horizontal cutting edge 37 is located directly below but rearward of the end 33 of first blade 29.

The longitudinal blade edge 39 is located in a vertical plane including the bottom face edge 13. The bottom end of edge 39 intersects the horizontal cutting edge 37 at the bottom face edge 13, as can be seen in FIG. 4.

When the carriage and blade assembly are pulled in a forward direction as noted in FIG. 5, the edge 30 of first blade 29 will first engage the face material between the face top edge 12 and the elevation of first blade bottom end 33. A deflector surface **29*a* is provided by blade 29 to deflect the material removed thereby laterally onto the receiving and transporting means 19. Thus, a "first" portion "X" (FIG. 5) is taken through the face material to a level slightly below the elevation of the second blade rear end 38**.

Second blade 36 moves simultaneously but rearward of the first blade 29 and will operate on a remaining portion "Y" of the layer of material as shown in FIG. 5. Cutting edge 37 first engages this material and wedges it upwardly along the inclined blade surface. Longitudinal edge 39 scrapes along the edge of face 11 to form the upright surface 40. Cutting blade 36 may also include some form of deflector surface to assure movement of the loose material onto the earth receiving and transporting means 19.

It may be noted that very little downward pressure is exerted against blade 36 since it operates on only a portion ("Y") of the full depth of cut. The full "cut" is shared by the two blades 29 and 36 and, since they are longitudinally spaced, the weight of the two separate portions "X" and "Y" are separated and received only by the respective blades 29 and 36. In previous mechanisms, the horizontal cutting edge has been located forward of the upright cutting edge so that as the cutting assembly is moved along a face, the full weight and resistance of the entire swath is placed against the lower blade. It may therefore be seen that the blade assembly described herein can reduce considerably the amount of drag produced as the assembly is moved along the length of face 11 to remove a layer of material therefrom.

The drive means 18 is shown in FIGS. 1 and 2 as being a hydraulic cylinder 43 operatively connected to the blade assembly and carriage by a sheave and cable assembly 44. Cylinder 43 has one end fixed to the framework 15. The remaining free piston end of cylinder 43 mounts a first sheave 45. A second sheave 46 is mounted on framework 15 adjacent the stationary end of cylinder 43. A third sheave 47 is rotatably mounted to framework 15 adjacent the upper support tracks 21. A cable 48 is comprised of a multiplicity of cable strands and is anchored at 49 to framework 15. This anchor point 49 is directly adjacent to the second sheave 46. The cable strands extend upwardly along the framework 15 to wrap about the movable sheave 45 on the piston end of cylinder 43. The cable strands extend from sheave 45 downwardly, around sheave 46 then upwardly again to engage the third sheave 47. From sheave 47, the cable extends downwardly again to an anchor point 50 (FIG. 5, dashed lines) on carriage 16.

The cylinder and cable arrangement is designed so that extension of the cylinder will cause corresponding movement of the carriage and blade assembly in a forward direction. Retraction of the cylinder will correspondingly cause extension of the cable length between sheave 47 and anchor point 50. Therefore, if the device is located on an incline as shown, the carriage will lower itself by gravity along the tracks 27 and 28 to a lower position. FIG. 1 shows the carriage approximately midway between a lowered position along its path (adjacent the lower support tracks 22) and an upper position (adjacent upper support tracks 21). The geometry of cylinder 43, cable 48 and sheaves 45–47 is such that a one-foot extension of cylinder 43 will result in a corresponding movement of six feet by carriage 16 along the framework 15. The required stroke for cylinder 43 is thereby held to a minimum.

Layers of material that have been removed by the blade assembly during forward movement of carriage 16 are deposited on the earth-receiving and transporting means 19. Means 19 is basically comprised of a longitudinal conveyor assembly 54 and a lateral conveyor assembly 58. Longitudinal conveyor assembly 54 includes an upper working flight 55 (FIG. 4) that extends the full length of framework 15 and beyond the "cutting stroke" of blade assembly 17. The working flight 55 of conveyor assembly 54 is elevationally located below the end 38 of second cutting blade 36. Therefore, material deflected by blade 36 will be carried over the plate 24 and onto surface 55. Also, the deflecting surface **29*a* of first blade 29 is oriented to direct material removed by blade 29 in a direction toward the working flight 55. Therefore, as the carriage is moved in a forward direction, the blade assembly will remove a layer of material from the face and that material will be directed onto the working flight 55. The flight 55 is powered to move the material in a rearward direction toward the bottom support tracks 22. Material is discharged from the working flight 55 at a discharge end 57 (FIGS. 1 and 3**).

The lateral conveyor 58 is located directly below and substantially perpendicular to the longitudinal conveyor 54. Lateral conveyor 58 is designed to receive material from conveyor 54 and to move such material laterally of the face 11 to a position remote of the face area. It is intended that the conveyor 58 extend a distance equal to the lateral dimension of the complete excavation. Therefore, this conveyor 58 could be of substantial length.

If a continuous flow of material is desired to be deposited onto the lateral conveyor 58, a surge hopper (not shown) may be provided on the framework 15 to receive the successive layers of material as they are cut from face 11 and delivered by conveyor 54. This surge hopper could utilize a metered discharge which would deliver a continuous flow of material onto the working flight of the lateral conveyor 58. A situation such as this would be desirous in a mining operation where the material could be delivered directly to processing apparatus at a continuous rate.

Operation of the present excavator may now be easily understood.

Prior to each shearing operation, the framework 15 is lifted by assemblies 23 and moved laterally toward the face 11 through operation of the tracks 21 and 22. The lift assemblies may then be utilized to lower the frame and thereby determine the depth of cut or thickness of the layer to be removed. If continuous flow along the lateral conveyor 58 is desired, this movement is substantially the same for each layer removed from the face.

To initiate the operation, the cylinder 43 is extended. This causes corresponding movement of the carriage 16 and blade assembly 17 in a forward direction along the face 11. The upright first blade 29 is first to engage face 11 with edge 30 removing material portion "X" between the face top edge 12 and the bottom blade end 33. This removed material is deflected by surface 29*a* toward the working conveyor flight 55. As the carriage is moved on forwardly along the length of face 11, the second blade 36 comes into contact with the face 11 to remove portion "Y" of the layer that was not removed by first blade 29. The inclined blade 36 deflects this material upwardly over the plate 24 and onto working flight 55. This cutting action continues as the blade assembly is pulled by cables 48 in the forward direction along face 11.

Once the blade assembly has been drawn along the full length of face 11, the cylinder 43 may be retracted, allowing carriage 16 to move freely and gravitationally back to the original starting position adjacent the lower support tracks 22. During this backward motion, no material is removed from the face 11 and no material is delivered to the working flight 55.

Once the carriage and blade assembly is located at the starting position, the lift assemblies 23 and tracks 21 and 22 are again operated to move the complete excavator 10 laterally toward the newly formed face 11 to reposition the blades 28 and 36 for the next successive cut. This operation continues until a desired amount of material is removed from the excavation site.

It may have become evident from the above description, that various changes and modifications may be made therein. Therefore, only the following claims are to be taken as definitions of this invention.

What I claim is:

1. A shearing excavator for stripping earth from a horizontally elongated upright face extending elevationally between a longitudinal top edge and a longitudinal bottom edge by removing successive layers of earth along the length of the face, comprising:

a longitudinally elongated framework extending along the length of the face in substantial parallel relation thereto:

a carriage movably mounted to the framework for longitudinal movement thereon in opposite forward and backward directions along the length of the framework adjacent the face;

earth receiving and transporting means mounted on said framework;

a blade assembly mounted to the carriage including:

a. upright first blade means having an upright blade edge leading downwardly from the top edge of the face to a bottom blade end at an elevation above that of the bottom edge of the face for scraping against the face to make a cut while the carriage is moved in a forward direction, said first blade means including a deflection surface for directing loose earth away from said face and toward said earth receiving and transporting means;

b. inclined second blade means having a horizontal cutting edge leading outward from the framework to the bottom face edge, said horizontal cutting edge being located rearward of the upright blade edge of said first blade means, said second blade means leading rearwardly from the horizontal cutting edge to a rearward blade end adjacent earth receiving and transporting means at an elevation above the cut made by the bottom blade end of said first blade means;

and drive means for moving the carriage and blade assembly relative to the framework along the face in the forward and rearward directions.

2. The shearing excavator as defined by claim 1 wherein the upright blade edge of said first blade means is inclined laterally with respect to the length of said face, its upper end at the top face edge being spaced horizontally outward from the carriage a distance greater than the bottom end thereof.

3. The shearing excavator as defined by claim 1 wherein the inclined second blade means includes a longitudinal edge inclined relative to the forward direction of movement of the carriage relative to the framework and leading downwardly to the bottom face edge, said longitudinal edge being located in a vertical plane, the bottom end of the longitudinal edge intersecting the horizontal cutting edge of said second plate means at said bottom face edge.

4. The shearing excavator as defined by claim 1 wherein the earth receiving and transporting means includes a longitudinal elongated powered conveyor assembly mounted to the framework and having an upper working flight extending the full length of the face.

5. The shearing excavator as defined by claim 4 wherein the elongated powered conveyor includes a material discharge end adjacent an end of the face; and wherein the earth receiving and transporting means further includes an elongated powered lateral conveyor means for receiving material from the discharge end of the longitudinal conveyor and for moving the received material to the remote location.

* * * * *